US010603897B2

(12) United States Patent
Liu

(10) Patent No.: US 10,603,897 B2
(45) Date of Patent: Mar. 31, 2020

(54) INK SPLITTING MULTI-ROLL CLEANER FOR A VARIABLE DATA LITHOGRAPHY SYSTEM

(71) Applicant: Xerox Corporation, Norwalk, CT (US)

(72) Inventor: Chu-Heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 104 days.

(21) Appl. No.: 15/847,010

(22) Filed: Dec. 19, 2017

(65) Prior Publication Data

US 2019/0184698 A1 Jun. 20, 2019

(51) Int. Cl.

| | |
|---|---|
| ***B41F 35/06*** | (2006.01) |
| ***B41F 35/00*** | (2006.01) |
| ***B41F 7/26*** | (2006.01) |
| ***B41F 7/00*** | (2006.01) |
| ***B41F 35/02*** | (2006.01) |

(52) U.S. Cl.
CPC ..... *B41F 35/002* (2013.01); *B41F 7/00* (2013.01); *B41F 7/26* (2013.01); *B41F 35/02* (2013.01); *B41P 2235/22* (2013.01)

(58) Field of Classification Search
CPC ..... B41F 35/06
USPC ..... 101/425
See application file for complete search history.

(56) References Cited

U.S. PATENT DOCUMENTS 4,729,310 A * 3/1988 Love, III ..... B41C 1/055 101/157
6,024,017 A * 2/2000 Okuda ..... B41F 31/18 101/148
6,318,259 B1 11/2001 Chou et al.
6,336,404 B1 * 1/2002 Sakamoto ..... B41C 1/1075 101/142
6,553,205 B1 * 4/2003 Liu ..... G03G 15/101 399/348
9,771,653 B2 * 9/2017 Zhang ..... G03G 21/0088
2005/0005790 A1 * 1/2005 Price ..... B41F 31/004 101/350.4
2006/0029430 A1 * 2/2006 Hosoya ..... G03G 15/11 399/249
2010/0005988 A1 * 1/2010 Takahashi ..... B41F 17/22 101/425
2011/0132213 A1 6/2011 Dejoseph et al.
2012/0103212 A1 5/2012 Stowe et al.
2012/0103217 A1 5/2012 Stowe et al.
2012/0103221 A1 * 5/2012 Stowe ..... B41C 1/1033 101/483
2013/0064591 A1 * 3/2013 Salalha ..... G03G 15/104 399/357
2013/0327237 A1 12/2013 Jia et al.
(Continued)

*Primary Examiner* — Anthony H Nguyen
(74) *Attorney, Agent, or Firm* — Caesar Rivise, PC

(57) ABSTRACT

A cleaning subsystem for a variable data lithography system includes a cleaning roller train having a cleaning member in physical contact with an imaging member such that residual ink remaining on the imaging member, such as following transfer of an inked latent image from the imaging member to a substrate, adheres to the cleaning member through cohesion and is thereby removed from the imaging member. The cleaning roller train uses the ink-splitting mechanics to remove, transport and collect the ink waste. The key cleaning roller train is a thin but uniform layer of ink on the cleaning member that contacts the imaging member causing removal on the residual ink through cohesion.

18 Claims, 3 Drawing Sheets

(56) References Cited

U.S. PATENT DOCUMENTS

| | | | | |
|---|---|---|---|---|
| 2014/0013978 | A1* | 1/2014 | Veres | G03G 17/02<br>101/465 |
| 2015/0378263 | A1* | 12/2015 | Stowe | G03F 7/24<br>355/30 |

* cited by examiner

INK SPLITTING MULTI-ROLL CLEANER FOR A VARIABLE DATA LITHOGRAPHY SYSTEM

BACKGROUND

1. Field of the Disclosed Embodiments

This invention relates generally to ink-based digital printing systems, and more particularly, to variable lithographic imaging member cleaning systems having a cleaning roller train to remove the residual ink from an imaging member.

2. Related Art

Conventional lithographic printing techniques cannot accommodate true high-speed variable data printing processes in which images to be printed change from impression to impression, for example, as enabled by digital printing systems. The lithography process is often relied upon, however, because it provides very high quality printing due to the quality and color gamut of the inks used. Lithographic inks are also less expensive than other inks, toners, and many other types of printing or marking materials.

Ink-based digital printing uses a variable data lithography printing system, or digital offset printing system, or a digital advanced lithography imaging system. A "variable data lithography system" is a system that is configured for lithographic printing using lithographic-like inks and based on digital image data, which may be variable from one image to the next. "Variable data lithography printing," or "digital ink-based printing," or "digital offset printing," or digital advanced lithography imaging is lithographic printing of variable image data for producing images on a substrate that are changeable with each subsequent rendering of an image on the substrate in an image forming process.

For example, a digital offset printing process may include transferring radiation-curable ink onto a portion of an imaging member (e.g., fluorosilicone-containing imaging member, imaging blanket, and printing plate) that has been selectively coated with a dampening fluid layer according to variable image data. According to a lithographic technique, referred to as variable data lithography, a non-patterned reimageable surface of the imaging member is initially uniformly coated with the dampening fluid layer. Regions of the dampening fluid are removed by exposure to a focused radiation source (e.g., a laser light source) to form pockets. A temporary pattern in the dampening fluid is thereby formed over the printing plate. Ink applied thereover is retained in the pockets formed by the removal of the dampening fluid. The inked surface is then brought into contact with a substrate at a transfer nip and the ink transfers from the pockets in the dampening fluid layer to the substrate. The dampening fluid may then be removed, a new uniform layer of dampening fluid applied to the printing plate, and the process repeated.

Digital printing is generally understood to refer to systems and methods of variable data lithography, in which images may be varied among consecutively printed images or pages. "Variable data lithography printing," or "ink-based digital printing," or "digital offset printing" are terms generally referring to printing of variable image data for producing images on a plurality of image receiving media substrates, the images being changeable with each subsequent rendering of an image on an image receiving media substrate in an image forming process. "Variable data lithographic printing" includes offset printing of ink images generally using specially-formulated lithographic inks, the images being based on digital image data that may vary from image to image, such as, for example, between cycles of an imaging member having a reimageable surface. Examples are disclosed in U.S. Patent Application Publication No. 2012/0103212 A1 (the '212 Publication) published May 3, 2012 based on U.S. patent application Ser. No. 13/095,714, and U.S. Patent Application Publication No. 2012/0103221 A1 (the '221 Publication) also published May 3, 2012 based on U.S. patent application Ser. No. 13/095,778. These applications are commonly assigned, and the disclosures of both are hereby incorporated by reference herein in their entirety.

Digital offset printing inks differ from conventional inks because they must meet demanding rheological requirements imposed by the variable data lithographic printing process while being compatible with system component materials and meeting the functional requirements of subsystem components, including wetting and transfer where the imaging member surface supports an image that is only printed once and is then refreshed. Each time the imaging member transfers its image to the print media or substrate, all history of that image remaining on the imaging member surface must be eliminated to avoid ghosting. Inevitably some film-splitting of the ink occurs at the transfer nip such that complete ink transfer to the print media cannot be guaranteed as residual ink may remain. This problem is a long felt need in the digital offset printing industry, with these systems requiring cleaning subsystems after the transfer nip to continuously remove post transfer residual ink from the reimageable surface of the imaging member prior to formation of the next print image. Known cleaning subsystems have been known to use wiping with a cleaning web or a cleaning pad, blade scraping, and chemical methods to remove the residual ink. However, these cleaning subsystems do a poor job in cleaning the blanket or removing the residual ink thereon. Additionally, chemical methods tend to be very complicated with chemical waste and have yet to show their feasibility as a robust cleaning subsystem.

The inventor, aided by careful empirical testing and materials analysis, found and prescribe specific materials and system layout guidelines for more efficient and effective residual ink removal.

SUMMARY OF THE DISCLOSED EMBODIMENTS

A cleaning subsystem for a variable data lithography system includes a cleaning roller train having a cleaning member in physical contact with an imaging member such that residual ink remaining on the imaging member, such as following transfer of an inked latent image from the imaging member to a substrate, adheres to the cleaning member through cohesion and is thereby removed from the imaging member. The cleaning roller train uses the ink-splitting mechanics to remove, transport and collect the ink waste. The key component of this cleaning roller train is a thin but uniform layer of ink on the cleaning member that contacts the imaging member causing removal on the residual ink through cohesion.

BRIEF DESCRIPTION OF THE DRAWINGS

Various exemplary embodiments of the disclosed systems and methods will be described, in detail, with reference to the following drawings, in which.

DETAILED DESCRIPTION

Figure 1:
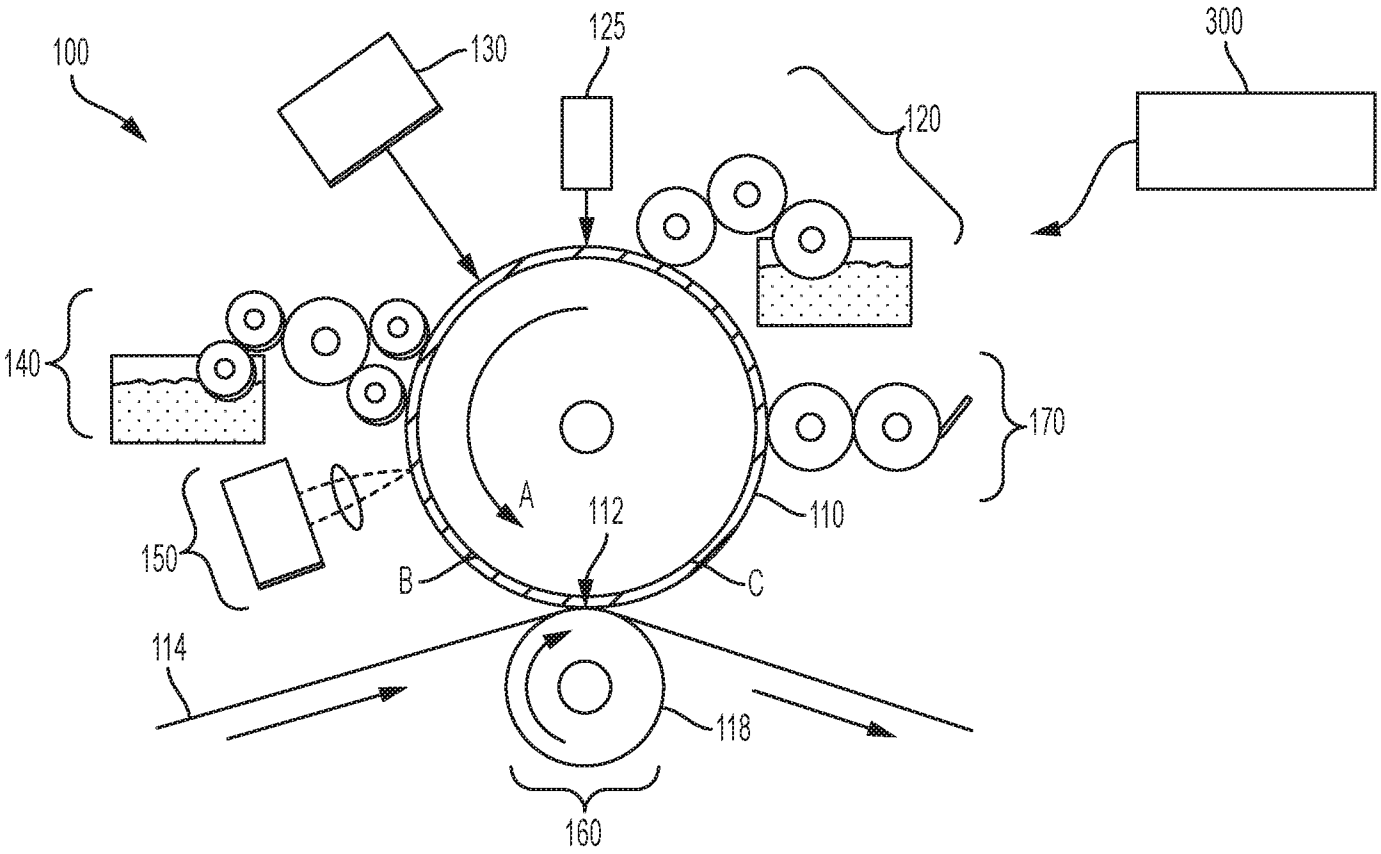
FIG. 1 is a side view of a related art variable lithographic printing system with controller in accordance to an embodiment.

Exemplary embodiments are intended to cover alternatives, modifications, and equivalents as may be included within the spirit and scope of the compositions, methods, and systems described below.

In one aspect, a variable data lithography system, comprising an imaging member having an arbitrarily reimageable imaging surface; a dampening solution subsystem for applying a layer of dampening solution to the imaging surface; a patterning subsystem for selectively removing portions of the dampening solution layer so as to produce a latent image in the dampening solution; an inking subsystem for applying ink over the imaging surface such that the ink selectively occupies regions where dampening solution was removed by the patterning subsystem to thereby form an inked latent image; an image transfer subsystem for transferring the inked latent image to a substrate; and, a cleaning subsystem for removing residual ink from the surface of the imaging member, the cleaning subsystem comprising: a cleaning roller train having a cleaning member with a smooth and thin layer of ink on its surface in physical contact with the imaging member such that residual ink remaining on the imaging member following transferring the inked latent image to the substrate at the image transfer subsystem adheres to the cleaning member.

In another aspect, wherein the cleaning roller train comprises cleaning member, transport member in physical contact with the cleaning member, and a collection member.

In another aspect, wherein the cleaning member comprises a smooth roll and/or hard roll.

In another aspect, wherein an adhesion of the residual ink to the imaging member is less than a cohesion of the residual ink to the thin and smooth layer of ink at the cleaning member.

In another aspect, wherein the cleaning member is a roller.

In yet another aspect, wherein the cleaning member is a consumable component and disposed to be readily replaceable within the cleaning roller train.

In another aspect, wherein the transport member contacts the cleaning member to acquire therefrom a first portion of such residual ink while the thin layer of ink remains on the surface portion of the cleaning member.

In another aspect, wherein the thin layer of ink on the surface of the cleaning member is maintained by the transport member at a predetermined thickness.

In another aspect, further comprising: at least one motor for independently controlling the transport member and/or the collection member.

In yet another aspect, wherein the collection member accumulates the acquired first portion of the residual ink at the transport member.

In yet another aspect, further comprising a rheology modifying agent.

In yet another aspect, wherein the rheology modifying agent is a radiation source configured to increase accumulated residual ink viscosity before the collection member contacts the transport member.

In another aspect, wherein the collection member is a cleaning web that is translatable and arranged to directly contact the transport member to accumulate the acquired first portion of the residual ink at the transport member.

In a further aspect, a cleaning subsystem for removing residual ink from a surface of an imaging member in a variable data lithography system, comprising a cleaning roller train having a cleaning member with a smooth and thin layer of ink on its surface in physical contact with the imaging member such that the residual ink remaining on the imaging member following transferring of an inked latent image to a substrate adheres to the cleaning member; wherein an adhesion of the residual ink to the imaging member is less than cohesion of the residual ink to the thin and smooth layer of ink at the cleaning member.

The modifiers "about" and/or "substantially," when used in connection with any quantity or feature, are intended to be inclusive of any stated values and as having a meaning dictated by the context. For example, these modifiers may be used to include at least the degree of error associated with any measurement or feature that may be considered reasonable in the particular context. When used with a specific value, the use of the modifier "about" should also be considered as disclosing that specific value.

The terms "dampening fluid", "dampening solution", or "fountain solution" generally refers to a material such as fluid that provides a change in surface energy. The solution or fluid can be a water or aqueous-based fountain solution which is generally applied in an airborne state such as by steam or by direct contact with an imaging member through a series of rollers for uniformly wetting the member with the dampening fluid. The solution or fluid can be non-aqueous consisting of, for example, silicone fluids (such as D3, D4, D5, OS10, OS20 and the like), and polyfluorinated ether or fluorinated silicone fluid.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of rollers" may include two or more rollers.

The terms "print substrate" or "substrate" generally refers to a usually flexible, sometimes curled, physical sheet of paper, Mylar material, plastic, or other suitable physical substrate for images, whether precut or web fed.

As used herein, the term "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs). A processor is capable of executing computer-executable instructions or data structures stored thereon.

Variable data digital lithographic (VDDL) image forming or VDDL printing is a term directed to a unique class of image forming operations in which specialized reimageable surface configurations of imaging members are provided to effect lithographic image forming operations in which images are changeable/changed on each imaging cycle of the device system implementing the image forming scheme and/or as each inked image is formed and passed through a transfer nip to transfer the inked image from the reimageable surface to an image receiving media substrate, or to an intermediate transfer or offset component for further transfer to the image receiving media substrate. In VDDL the area to form an image on the member can be arbitrarily selected or placed based on an imaging scheme.

A general description of the exemplary system 100 shown in FIG. 1 is provided here. Additional details regarding individual components and/or subsystems shown in the exemplary system 100 of FIG. 1 may be found in the 212 Publication.

As shown in FIG. 1, the exemplary system 100 may include an imaging member 110. The imaging member 110 in the embodiment shown in FIG. 1, although depicted as a drum, is not intended to imply that embodiments of such a device are necessarily restricted to containing a drum-type imaging member. The imaging member 110 in the exemplary system 100 is used to apply an inked image to a target image receiving media substrate 114 at a transfer nip 112. The transfer nip 112 is produced by an impression roller 118, as part of an image transfer mechanism 160, exerting pressure in the direction of the imaging member 110.

The exemplary system 100 may be used for producing images on a wide variety of image receiving media substrates 114. The 212 Publication explains the wide latitude of marking (printing) materials that may be used, including marking materials with pigment densities greater than 10% by weight. Increasing densities of the pigment materials suspended in solution to produce different color inks is generally understood to result in increased image quality and vibrancy. These increased densities, however, often result in significant restriction, or even a complete preclusion, in the use of such inks in certain image forming applications that are conventionally used to facilitate variable data digital lithographic image forming, including, for example, jetted ink image forming applications. It is the desire to capture the enhanced image quality in a variable data digital lithographic image forming system that led to the development of the exemplary system 100 and ongoing extensive experimentation to achieve optimum results.

As noted above, the imaging member 110 may be comprised of a reimageable surface (layer or plate) formed over a structural mounting layer that may be, for example, a cylindrical core, or one or more structural layers over a cylindrical core. A dampening solution subsystem 120 may be provided generally comprising a series of rollers, which may be considered as dampening rollers or a dampening unit, for uniformly wetting the reimageable surface of the imaging member 110 with a layer of dampening fluid or fountain solution, generally having a uniform thickness. Once the dampening fluid or fountain solution is metered onto the reimageable surface, a thickness of the layer of dampening fluid or fountain solution may be measured using a sensor 125 that provides feedback to control (controller 300) the metering of the dampening fluid or fountain solution onto the reimageable surface.

The controller 300 may be embodied within devices such as a desktop computer, a laptop computer, a handheld computer, an embedded processor, a handheld communication device, or another type of computing device, or the like. The controller 300 may include a memory, a processor, input/output devices, a display and a bus. The bus may permit communication and transfer of signals among the components of the controller 300 or computing device.

An optical patterning subsystem 130 may be used to selectively form a latent image in the uniform dampening fluid layer by image-wise patterning the dampening fluid layer using, for example, laser energy. It is advantageous to form the reimageable surface of the imaging member 110 from materials that should ideally absorb most of the laser energy emitted from the optical patterning subsystem 130 close to the reimageable surface. Forming the reimageable surface of such materials may advantageously aid in substantially minimizing energy wasted in heating the dampening fluid and coincidentally minimizing lateral spreading of heat in order to maintain a high spatial resolution capability. The mechanics at work in the patterning process undertaken by the optical patterning subsystem 130 of the exemplary system 100 are described in detail with reference to FIG. 5 in the 212 Publication. Briefly, the application of optical patterning energy from the optical patterning subsystem 130 results in selective evaporation of portions of the uniform layer of dampening fluid in a manner that produces a latent image. As can be well understood, such selective evaporation requires a targeted application of comparatively intense optical energy resulting in a high degree of localized heating to temperature in excess of 300° F. in through the dampening fluid and at least in the reimageable surface.

The patterned layer of dampening fluid comprising a latent image over the reimageable surface of the imaging member 110 is then presented or introduced to an inker subsystem 140. The inker subsystem 140 is usable to apply a uniform layer of ink over the patterned layer of dampening fluid and the reimageable surface. In embodiments, the inker subsystem 140 may use an anilox roller to meter ink onto one or more ink forming rollers that are in contact with the reimageable surface. In other embodiments, the inker subsystem 140 may include other traditional elements such as a series of metering rollers to provide a precise feed rate of ink to the reimageable surface. The inker subsystem 140 may deposit the ink to the pockets representing the imaged portions of the reimageable surface, while ink deposited on the unformatted portions of the dampening fluid layer will not adhere to those portions.

Cohesiveness and viscosity of the ink residing on the reimageable surface may be modified by a number of mechanisms, including through the use of some manner of rheology control subsystem 150. In embodiments, the rheology control subsystem 150 may form a partial crosslinking core of the ink on the reimageable surface to, for example, increase ink cohesive strength relative to an adhesive strength between the ink and the reimageable surface. In embodiments, certain curing mechanisms may be employed, which may include, for example, optical or photo curing, heat curing, drying, or various forms of chemical curing. Cooling may be used to modify rheology of the transferred ink as well via multiple physical, mechanical or chemical cooling mechanisms.

Substrate marking occurs as the ink is transferred from the reimageable surface to a substrate of image receiving media 114 using the transfer subsystem 160. With the adhesion and/or cohesion of the ink having been modified by the rheology control system 150, the ink transfers substantially completely preferentially adhering to the substrate 114 as it separates from the reimageable surface at the transfer nip 112. Careful control of the temperature and pressure conditions at the transfer nip 112, combined with rheology adjustment of the ink, may allow transfer efficiencies for the ink from the reimageable surface to the substrate 114 to exceed 95%. While it is possible that some dampening fluid may also wet substrate 114, the volume of such transferred dampening fluid will generally be minimal so as to rapidly evaporate or otherwise be absorbed by the substrate 114.

Finally, a cleaning subsystem or cleaning system 170 is provided to remove residual products, including non-transferred residual ink and/or remaining dampening solution from the reimageable surface in a manner that is intended to prepare and condition the reimageable surface to repeat the above cycle for image transfer in variable data digital lithographic image forming operations in the exemplary system 100. The cleaning system 170 consists of multiple rolls or surfaces which in combination act as a cleaning ink train. A cleaning surface takes the residual ink away from the blanket 110. During operation, this surface does not need to be completely clean before coming into contact with blanket 110. The last surface of the cleaning ink train is a collection surface where the ink waste will accumulate until being disposed. One or more rollers/surfaces in the middle through ink splitting mechanics smoothes the ink layers at the cleaning surface and transport the inks from the blanket (input) to the collection member (output).

The reimageable surfaces of imaging members 110 must satisfy a range of often-competing requirements including (1) surface wetting and pinning the dampening fluid or fountain solution, (2) efficiently absorbing optical radiation from the laser or other optical patterning device, (3) wetting and pinning the ink in the discretely imaged areas of the reimageable surfaces, and (4) releasing the ink, preferably at efficiencies that exceed 95%. The ink release is controlled to promote the highest levels of ink transfer efficiency to the image receiving media substrate 114 to produce high quality images, limit waste, and minimize burden on downstream cleaning systems by yielding a substantially clean imaging surface at an exit of the transfer nip 112.

Reimageable surfaces of imaging members are formed of materials that, through extensive and ongoing experimentation, are determined to advantageously support the steps of the ink-based variable data digital lithographic printing process carried into effect according to systems such as those shown, in an exemplary manner, in FIG. 1. As mentioned above, such reimageable surfaces may be formed of, for example, silicone and fluorosilicone elastomers for the reasons noted above.

The proprietary variable data digital lithographic image forming process employing an image forming system substantially configured according to the example shown in FIG. 1 require offset type inks that are specifically designed and optimized to be compatible with the different subsystems, including, and particularly, ink delivery sub-system and imaging sub-system, to enable high quality digital lithographic printing at high speed.

Reference is made to the drawing to accommodate understanding of an exemplary physical application of the disclosed inks for interaction with inking sub-systems, including Anilox roller inking sub-systems, and reimageable surfaces or other surfaces of imaging components in an image forming system, particularly an variable data digital lithographic image forming system, a configuration of which is shown by way of example in FIG. 1.

The disclosed embodiments propose a cleaner that primarily uses ink-splitting mechanics to remove, transport and collect the ink waste or residual ink at the imaging member 110. By its design nature, Variable data digital lithographic inks are perfectly suited for ink splitting mechanics. A key component of the ink splitting is to keep a thin but uniform layer of ink on the first surface that contacts the blanket 110 and cohesion forces pull the ink from the blanket onto the thin layer of the member at the cleaning ink train.

Figure 2:
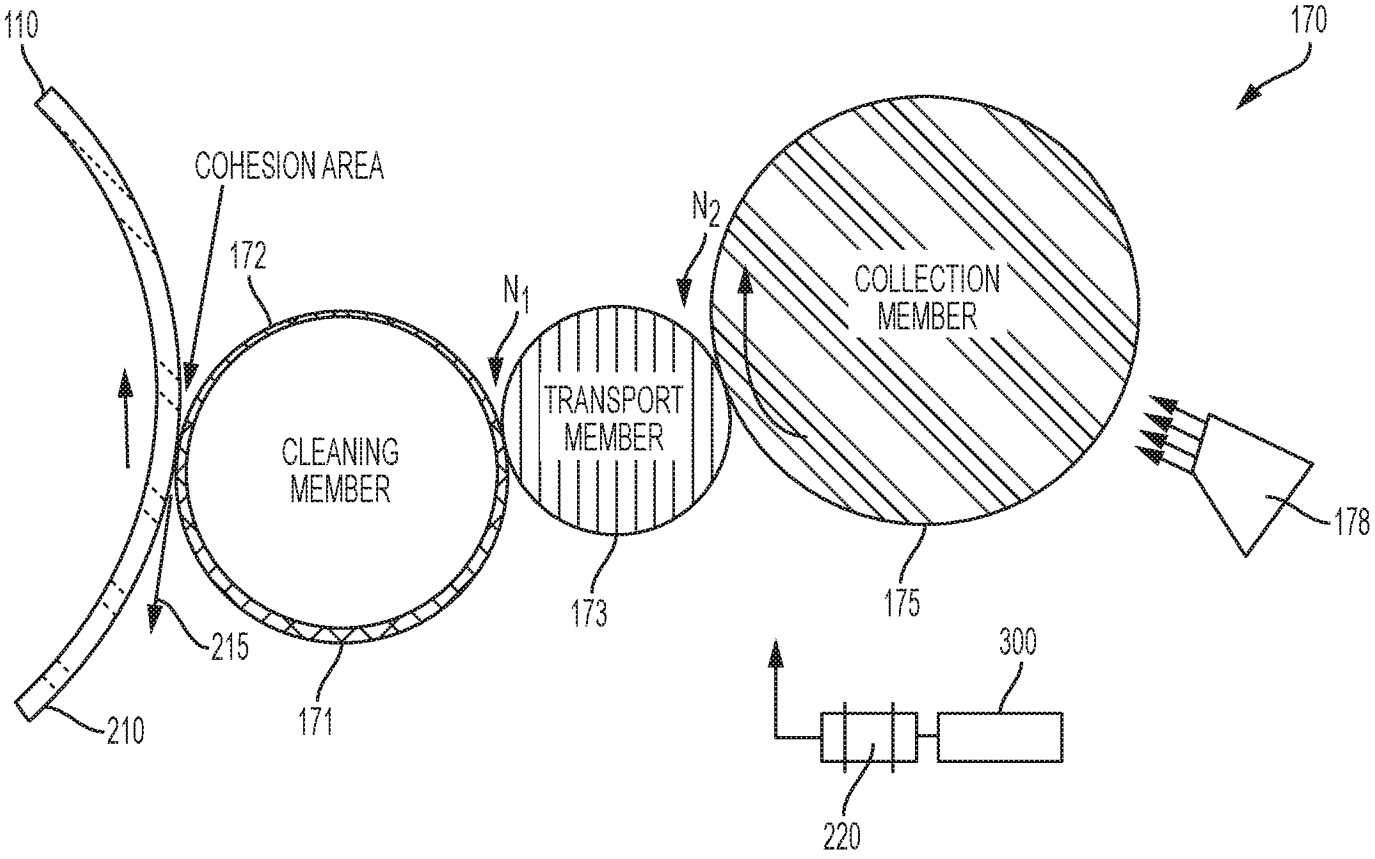
FIG. 2 is a side view of a variable lithographic printing system with a roller based cleaning station usable with a viscosity control unit in accordance with an embodiment.

FIG. 2 is a side view of a variable lithographic printing system with a roller based cleaning station usable with a viscosity control unit in accordance with an embodiment. The cleaning subsystem 170 or cleaning roller train comprises a cleaning member 171, transport member 173, collection member 175, and optional rheology agent or viscosity control unit 178 and motor to act on the members. These members, especially the collection member, can be consumable components and can be disposed to be readily replaceable within the cleaning roller train 170.

The members forming the cleaning roller train can be selected from hard or soft rolls and manufactured from plastics such as polyester, regular smooth rubber, metal rollers such as aluminum, stainless steel and chrome rolls and flexible coated or uncoated substrates like a web or cartridge.

The cleaning member 171 performs the initial cleaning operation. The cleaning member 171 surface is in physical contact with the imaging member 110 such that residual ink 210 remaining on the imaging member following transferring the inked latent image to the substrate at the image transfer subsystem 160 adheres to the cleaning member 171. The key characteristic of this operation is that the cleaning member 171 comes into contact 215 with the VDDL blanket 110 with a thin and smooth layer of ink 172 on its surface. Under normal operation, the surface is never really clean, i.e., free of ink. The operation is based on the principle that the adhesion of the ink to the cleaning member 171 and the cohesion of the ink is significantly greater than the adhesion of the ink to the blanket 110. Upon separation from the point of contact 215, all the ink that was originally on the cleaning surface and the residual ink on the blanket 110 will be staying on the cleaning surface. To maintain the cohesion pulling force the ink layer 172 on the cleaning member 171 is maintained at a predetermined thickness ($\Delta$) in the range of 0.25 μm to 3.00 μm on the surface of the cleaning member. Experimentally for best performance, the predetermined thickness on the surface of the cleaning member 171 was found to be slightly above 1 μm and changed based on the number of passes.

To maintain good cleaning performance, this layer of ink 172 has to be smooth, otherwise, local spots of thick ink will offset and back-transfer the ink to the blanket.

The transport member 173 performs the functions of cleaning and smoothing the thin layer 172 on the cleaning member. The transport member 173 makes sure that the cleaning surface is smooth and that the ink layer 172 on the cleaning surface will not increase to a level above the predetermined thickness ($\Delta$) at about 1 μm. Through repeated ink splitting, with optional oscillatory motion motor 220—the rolls moving in the cross-process direction—the ink layer will be smooth.

During VDDL printing or motion of the cooperating members of the cleaning ink train 170, the ink film (layer 172) on the cleaning member 171 may become uneven, for example showing streaks, valleys, grooves, peaks or ridges; the thus non-uniform ink film on the cleaning member 171 will be smoothed under pressure of the force exerted by surface portion of transport member 173. This pressure can be adjusted by use of springs, cams, and motor 220 under the control of a regulating device such as controller 300. The transport member 173 will reciprocate axially, by guidance of motor 220, and thus any unevenness of the ink film on the cleaning member 173 will be smooth and will be rendered uniform. The pressure of the members should be so adjusted that the transport member 173 will not squeeze off ink from the cleaning member. The cleaning member 171, thus, will have ink of uniform thickness applied thereto.

The transport of the ink will be facilitated by the equivalent ink thickness gradient between a first nip ($N_1$) formed by the cleaning and transporting members, and a second nip ($N_2$) formed by the transporting and collection members. Put it in a simple way: the ink thickness on the transport member 173 is thicker coming out of the first nip at the top portion of transport member 173, and thinner coming out of the second nip bottom portion of the transport member.

Ink splitting is the primary physics that drives the ink mass re-distribution at the exits of the nips like $N_1$ and $N_2$. Typically, ink will split in half (50/50) at the exits. However, if the ink viscosity is not even across the thickness in the nip region like $N_1$ and $N_2$, more ink will stay with the higher viscosity side. Differences in viscosity can be manufactured through careful placement of a rheological agent or a viscosity control unit that can take the form of heat or changes in the chemical composition or physical condition of the residual ink.

The function of the collection member 175 is to accumulate the residual ink, i.e., waste acquired by the transport member from the cleaning member, on the collection surface. The key to this accumulation action is to prevent the collected ink from going back to the transport member 173. The use of a viscosity control unit like a weak UV exposure to the ink waste on the collection member to slowly harden (increase the viscosity) the ink. This will create an asymmetric ink splitting situation that will favor the ink transport in the desired direction. As a result, ink will move from the transport member 173 to the collection member, maintaining a low level of ink on the transport member 173; which further promotes the ink transfer from the cleaning member 171 to the transport member 173. The weak UV exposure can be applied at selected intervals such for one revolution every "X" number of cycles. A low UV dosage at every 20 passes has been determined to be effective in preventing ink from going back onto transport member 173.

The viscosity control unit 178 shown in FIG. 2 is a UV exposure station with a UV curing lamp (e.g., standard laser, UV laser, high powered UV LED light source) that exposes the residual ink on the collection member surface to an amount of UV light (e.g., # of photons radiation) to polymerize the residual ink to a state that promotes more thorough single pass cleaning. The hardened residual ink will no longer split, meaning that it will either stay on the collection member surface or be removed completely. The level of UV light dosage sufficient to harden the residual ink may depend on several factors, such as the ink formulation (e.g., UV photo initiator type, concentration), UV lamp spectrum, VDDL processing speed and amount of residual ink on the collection member 175 surface. The member 175 can be a consumable component and can be disposed to be readily replaceable within the cleaning roller train 170.

Next, a second embodiment of the present invention will be described. Note that portions which are the same as those in the first embodiment described above are denoted by the same reference numerals, and descriptions of the same portions as those as in the first embodiment will be omitted.

Figure 3:
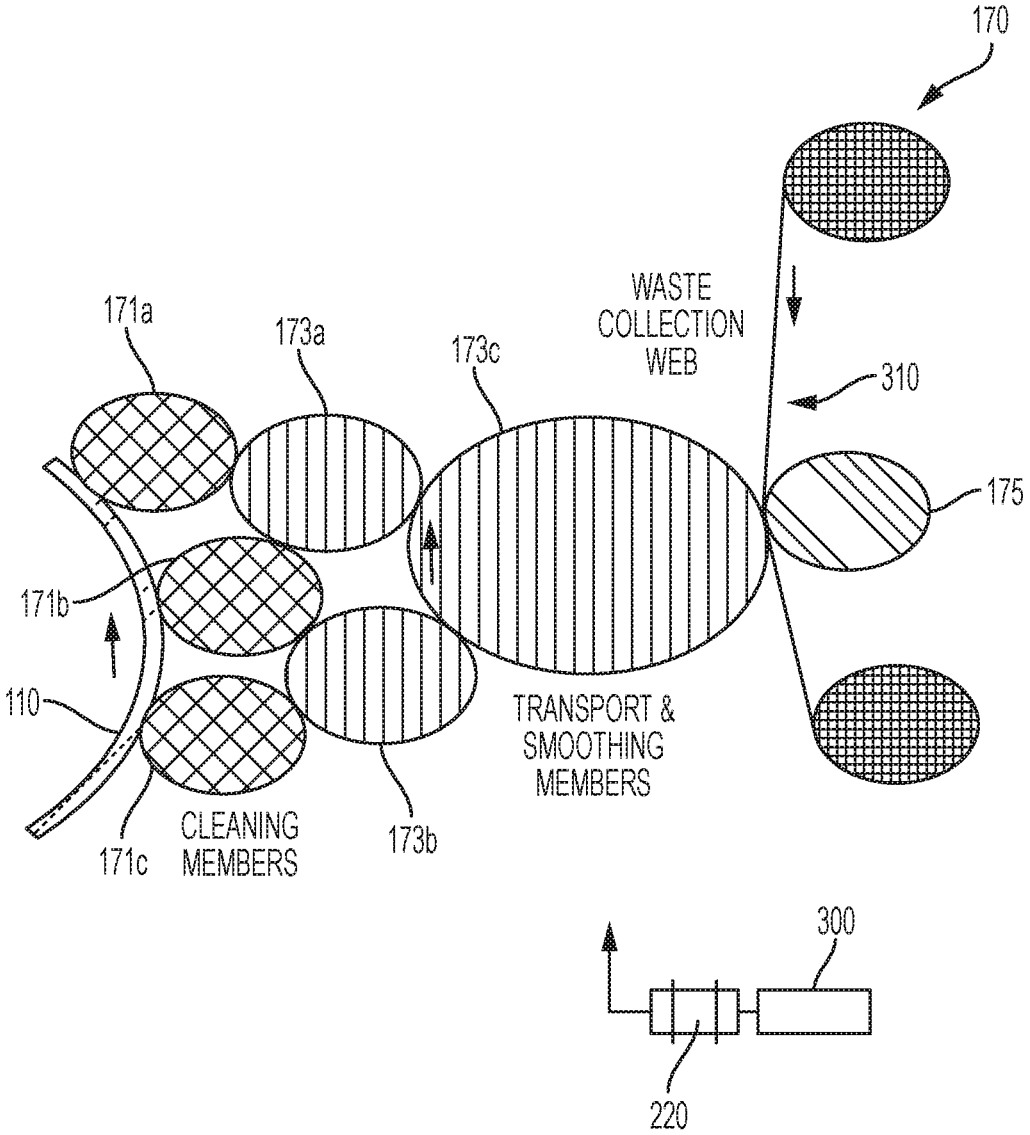
FIG. 3 illustrates a variable lithographic printing system with a roller based cleaning station with multiple members and waste collection web in accordance to an embodiment.

FIG. 3 illustrates a variable lithographic printing system with a roller based cleaning station with multiple members and waste collection web in accordance to an embodiment.

In the illustrated embodiment of FIG. 3, more rolls are used to improve the performance. This cleaning roller train 170 will be able to handle much more stress cases such as a surge of ink waste, extreme image non-uniformity. In addition, a web cleaning system 310 or waste collection web is proposed for the waste collection to increase the intervals for changing consumables. During operation of the web cleaning system 310, the feed cartridge and the take-up cartridge cause the web in physical contact with the transport member 173*c* and collection member 175 to transfer the residual ink to the web material such as coated paper. In this configuration, the web will be used multiple cycles before collecting enough waste on its web surface.

Advantages of the disclosed embodiments, compared to convention cleaning systems used in digital lithography, is that the use of shear forces to clean the imaging member 110 or other members is not required. As noted above shear cleaning methods like scraping, wiping, blade and the like fail to completely clean the imaging member and limited to the surface that can be used. The disclosed cleaning ink train 170 also removes paper dust from the blanket. The robustness of this cleaning system was proven through multiple runs.

The present disclosure has been described with reference to exemplary embodiments. Modifications and alterations will occur to others upon reading and understanding the preceding detailed description. It is intended that the present disclosure be construed as including all such modifications and alterations insofar as they come within the scope of the appended claims or the equivalents thereof.

What is claimed is:

1. A variable data lithography system, comprising:

an imaging member having an arbitrarily reimageable imaging surface;

a dampening solution subsystem for applying a layer of dampening solution to the imaging surface;

a patterning subsystem for selectively removing portions of the dampening solution layer so as to produce a latent image in the dampening solution;

an inking subsystem for applying ink over the imaging surface such that the ink selectively occupies regions where dampening solution was removed by the patterning subsystem to thereby form an inked latent image;

an image transfer subsystem for transferring the inked latent image to a substrate; and, a cleaning subsystem for removing residual ink from the surface of the imaging member, the cleaning subsystem comprising:

a cleaning roller train;

a cleaning member having on its surface a smooth and thin layer of ink and wherein the cleaning member is in physical contact with the imaging member to remove the residual ink;

wherein cohesion between the smooth and thin layer of ink and the residual ink removes the residual ink from the imaging member;

a transport member in physical contact with the cleaning member so as to maintain the smooth and thin layer of ink on the surface of the cleaning member at a predetermined thickness.

2. The variable data lithography system of claim 1, wherein the cleaning roller train comprises cleaning member, the transport member in physical contact with the cleaning member, and a collection member.

3. The variable data lithography system of claim 2, wherein the cleaning member comprises a smooth roll and/or hard roll.

4. The variable data lithography system of claim 2, wherein an adhesion of the residual ink to the imaging member is less than a cohesion of the residual ink to the thin and smooth layer of ink at the cleaning member.

5. The variable data lithography system of claim 4, wherein the cleaning member is a roller.

6. The variable data lithography system of claim 2, wherein the collection member is a consumable component and disposed to be readily replaceable within the cleaning roller train.

7. The variable data lithography system of claim 4, wherein the transport member contacts the cleaning member to acquire therefrom a first portion of such residual ink while the thin layer of ink remains on the surface portion of the cleaning member.

8. The variable data lithography system of claim 7, further comprising: at least one motor for independently controlling the transport member and/or the collection member.

9. The variable data lithography system of claim 8, wherein the collection member accumulates the acquired first portion of the residual ink at the transport member.

10. The variable data lithography system of claim 8, further comprising:

a rheology modifying agent.

11. The variable data lithography system of claim 10, wherein the rheology modifying agent is a radiation source configured to increase accumulated residual ink viscosity before the collection member contacts the transport member.

12. The variable data lithography system of claim 8, wherein the collection member is a cleaning web that is translatable and arranged to directly contact the transport member to accumulate the acquired first portion of the residual ink at the transport member.

13. A cleaning subsystem for removing residual ink from a surface of an imaging member in a variable data lithography system, comprising:

a cleaning roller train having a cleaning member with a smooth and thin layer of ink on its surface in physical contact with the imaging member;

a transport member in physical contact with the cleaning member so as to maintain the smooth and thin layer of ink on the surface of the cleaning member at a predetermined thickness;

wherein cohesion between the smooth and thin layer of ink and the residual ink removes the residual ink from the imaging member;

wherein an adhesion of the residual ink to the imaging member is less than the cohesion of the residual ink to the smooth and thin layer of ink at the cleaning member.

14. The cleaning subsystem of claim 13, wherein the cleaning roller train comprises the transport member in physical contact with the cleaning member, and a collection member in physical contact with the transport member.

15. The cleaning subsystem of claim 14, wherein the cleaning member and transport member comprise two or more rolls.

16. The cleaning subsystem of claim 15, wherein the collection member is a cleaning web that is translatable and arranged to directly contact the transport member.

17. The cleaning subsystem of claim 15, further comprising:

a viscosity control unit positioned downstream of the transport member in a process direction and configured to cure the residual ink on the collection member surface to produce a hardened residual ink.

18. The cleaning subsystem of claim 17, wherein the viscosity control unit is a radiation source configured to increase accumulated residual ink viscosity before the collection member contacts the transport member.

* * * * *